US011946330B2

(12) United States Patent
Stewart et al.

(10) Patent No.: US 11,946,330 B2
(45) Date of Patent: Apr. 2, 2024

(54) OR RELATING TO WELL ABANDONMENT AND SLOT RECOVERY

(71) Applicant: Ardyne Holdings Limited, Aberdeen (GB)

(72) Inventors: David Stewart, Aberdeen (GB); James Linklater, Aberdeen (GB); George Telfer, Aberdeen (GB)

(73) Assignee: ARDYNE HOLDINGS LIMITED (GB)

( * ) Notice: Subject to any disclaimer, the term of this patent is extended or adjusted under 35 U.S.C. 154(b) by 148 days.

(21) Appl. No.: 17/610,364

(22) PCT Filed: May 23, 2020

(86) PCT No.: PCT/EP2020/064342
§ 371 (c)(1),
(2) Date: Nov. 10, 2021

(87) PCT Pub. No.: WO2020/239642
PCT Pub. Date: Dec. 3, 2020

(65) Prior Publication Data

US 2022/0220820 A1 Jul. 14, 2022

(30) Foreign Application Priority Data

May 24, 2019 (GB) ..... 1907328

(51) Int. Cl.
*E21B 31/16* (2006.01)
*E21B 29/00* (2006.01)
*E21B 34/14* (2006.01)

(52) U.S. Cl.
CPC ..... *E21B 31/16* (2013.01); *E21B 29/002* (2013.01); *E21B 34/142* (2020.05)

(58) Field of Classification Search
CPC ..... E21B 34/142; E21B 34/101
See application file for complete search history.

(56) References Cited

U.S. PATENT DOCUMENTS 2,490,510 A 12/1949 Carleton
2,880,746 A 4/1959 Bernotas
(Continued)

FOREIGN PATENT DOCUMENTS

EP 2650468 A2 10/2013
EP 3063364 B1 2/2019
(Continued)

OTHER PUBLICATIONS

Intellectual Property Office of the UK Patent Office; Search Report for GB1907328.7; four pages; dated Oct. 30, 2019; Intellectual Property Office of the UK Patent Office, Newport, South Wales, United Kingdom.

(Continued)

*Primary Examiner* — David Carroll
(74) *Attorney, Agent, or Firm* — LAW OFFICE OF JESSE D. LAMBERT, LLC

(57) ABSTRACT

A downhole actuator (16) includes a piston (15) within a chamber (17) on which fluid can act on either side to hydraulically activate the actuator. A hydrostatic equilibrium device (18) and a valve (14) are mounted around the hydraulic actuator. With a radial port (28) of the hydrostatic equilibrium device closed and the valve closed to seal the string, pumping fluid through the string operates the actuator. Pressure overbalance prevents movement of the piston (15). The radial port (28) is opened to drain fluid from the string until equilibrium is reached with the annular volume and the piston (15) can be moved.

20 Claims, 5 Drawing Sheets

(56) References Cited

U.S. PATENT DOCUMENTS

| | | | | |
|---|---|---|---|---|
| 3,912,026 | A | 10/1975 | Crowe et al. | |
| 3,938,425 | A | 2/1976 | Kroffke | |
| 4,552,218 | A | 11/1985 | Ross et al. | |
| 5,101,895 | A | 4/1992 | Gilbert | |
| 6,167,970 | B1 | 1/2001 | Stout et al. | |
| 8,365,826 | B2 | 2/2013 | Braddick | |
| 2008/0236844 | A1 | 10/2008 | Gaudette et al. | |
| 2012/0031615 | A1* | 2/2012 | Connell | E21B 43/114 166/55 |
| 2012/0285684 | A1 | 11/2012 | Crow et al. | |
| 2013/0292119 | A1* | 11/2013 | Hilliard | E21B 33/1292 166/135 |
| 2015/0226031 | A1 | 8/2015 | Hekelaar | |
| 2017/0074068 | A1* | 3/2017 | Kucera | E21B 34/101 |
| 2018/0230763 | A1* | 8/2018 | Baudoin | E21B 34/101 |

FOREIGN PATENT DOCUMENTS

| | | | |
|---|---|---|---|
| GB | 2533022 | A | 6/2016 |
| GB | 2571094 | A | 8/2019 |
| WO | WO 02095180 | A2 | 11/2002 |

OTHER PUBLICATIONS

European Patent Office as ISA, International Search Report for PCT/EP2020/064342; dated Jul. 31, 2020; eleven pages; European Patent Office, Rijswijk, The Netherlands.

* cited by examiner 13
12
54
116
100
88
94
96
90
92
118
114

13
12
118
116
54
110
100
132
130
88
94
96
92
40
30
28
114

13
12
54
28
116
100
152
88
94
96
92
118
114

13
12
118
116
104
110
100
130
54
88
94
96
90
92
102
30
152
128
114
58

OR RELATING TO WELL ABANDONMENT AND SLOT RECOVERY

The present invention relates to apparatus and methods for well abandonment and slot recovery and in particular, though not exclusively, to an apparatus and method for casing recovery.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. This provides a need to provide tools which can pull long lengths of cut casing from the well to reduce the number of trips required to achieve casing recovery. However, the presence of drilling fluid sediments, partial cement, sand or other settled solids in the annulus between the outside of the casing and the inside of a surrounding downhole body e.g. outer casing or formation can act as a binding material limiting the ability to free the casing when pulled. Stuck casings are now a major issue in the industry.

Traditionally, cut casing is pulled by anchoring a casing spear to its upper end and using an elevator/top drive on a drilling rig. However, some drilling rigs have limited pulling capacity, and a substantial amount of power is lost to friction in the drill string between the top drive and the casing spear, leaving insufficient power at the spear to recover the casing. Consequently, further trips must be made into the well to cut the casing into shorter lengths for multi-trip recovery.

To increase the pulling capability, a downhole power tool (DHPT) available from the present Applicants, has been developed. After the casing has been located and engaged with a casing spear, hydraulically-set mechanically releasable slips anchor the DHPT to the wall of the larger ID casing above. A static pressure is applied to begin the upward movement of the cut casing, with the DHPT downhole multi-stage hydraulic actuator functioning as a hydraulic jack. After the stroke is completed, the anchors are released. The power section can be reset and the anchor re-engaged as many times as required. The DHPT is described in U.S. Pat. No. 8,365,826 assigned to the present Applicants, the disclosure of which is incorporated herein in its entirety by reference.

As in many downhole operations, it is practical to drive a hydraulic actuator by means of a liquid, typically a drilling fluid, which is pumped through a pipe string in which the tool is included. The actuator is then hydraulically connected in such a way that fluid may flow out of an access port in the pipe string and into the actuator. When pressure is to be created for driving an actuator in a downhole tool, it is known to close the flow of drilling fluid by means of a valve, which is placed below said access port. Most hydraulic actuators operate via movement of a piston across a chamber. The access port is arranged at a first end of the chamber and the fluid enters the chamber and acts on a first face or first side of the piston to move it through the chamber. An exhaust port is arranged in the opposing end of the chamber, so that fluid at the opposing face or second side of the piston is displaced out of the chamber to allow the required movement of the piston. This exhaust port is typically to the annulus surrounding the pipe string and tool in the well. When the actuator is to be re-set, the opposite displacement of fluid is required i.e. fluid on the first side is moved back into the pipe string while fluid enters the second side from the well annulus. In the DHPT, re-setting occurs by raising the pipe string which moves the piston relative to the chamber by virtue of each being connected to the pipe string or the cut casing.

However, when the hydraulic actuator is operated in a low level well, referred to as underbalanced, the hydrostatic imbalance between the column of fluid in the pipe string and the well annulus, prevents the piston being moved through the chamber so that the hydraulic actuator cannot be reset.

It is an object of the present invention is to provide a downhole assembly and method of operating an actuator on a pipe string in a low level well which obviates or mitigates at least some of the disadvantages of the prior art.

According to a first aspect of the present invention there is provided a downhole assembly for use in a low level well, comprising:

- a hydrostatic equalisation device, the hydrostatic equalisation device having a first tubular member with a first end configured to connect to a pipe string, a second tubular member arranged to move relative to the first tubular member and at least one radial port being selectively openable and closeable to give fluid access between a throughbore of the pipe string and an annulus around the downhole assembly;
- a hydraulic actuator to perform a task by the assembly downhole, the hydraulic actuator having a tool body including a central bore and a first end configured to connect to the hydrostatic equalisation device, a piston moveable in a chamber, the chamber having an access port from the central bore on a first side of the piston and an exhaust port to the annulus on a second side of the piston; and
- a valve, the valve including an obturating member arranged to block fluid flow through the central bore to divert fluid flow from the throughbore into the chamber via the access port; wherein:
- in a first configuration, the radial port is closed and the hydraulic actuator operates to perform the task by movement of the piston as fluid flows from the throughbore into the chamber via the access port to act on the first side of the piston; and
- in a second configuration, the radial port is opened and fluid flows from the throughbore to the annulus to equalise pressure between the throughbore and the annulus, and on equalisation fluid flows into the chamber via the exhaust port allowing movement of the piston to re-set the hydraulic actuator in preparation to repeat the task.

In this way, the hydrostatic equalisation device allows the column of fluid in the throughbore to drain from the pipe string until equilibrium is reached with the volume of fluid in the annulus, to allow the hydraulic actuator to re-set. As the hydrostatic equalisation device operates independently of the actuator, by mechanical means rather than hydraulic, the actuator can be re-set when the piston is at any position in the chamber.

Preferably, the first tubular member and the second tubular member are biased to move telescopically with a sliding seal located therebetween and such telescopic movement opens and closes the at least one radial port. In this way, applying tension or compression to the downhole assembly can operate the hydrostatic equalisation device. Alternatively or additionally, the first tubular member and the second tubular member are arranged to rotate relative to each other with a sliding seal located therebetween and such movement opens and closes the at least one radial port. In this way, rotation of the pipe string can be used to operate the hydrostatic equalisation device.

Preferably, the hydrostatic equalisation device includes a first spring to bias the first tubular member and the second tubular member in the first configuration. More preferably, setting down weight on the first tubular member moves the second tubular member telescopically in relation to the first tubular member and aligns at least one radial port on the first tubular member with at least one radial port on the second tubular member.

Preferably, a diameter of the sliding seal is less than a predominant diameter of the pipe string. In this way, the hydrostatic equalisation device will remain closed in the first configuration even with the pressure difference between the fluid in the throughbore and the annulus due to the hydrostatic head. The hydrostatic equalisation device may include a second spring to bias the first and second tubular members, wherein a force of the second string is adjustable. This can be adjusted to assist in overcoming the imbalance force to open the at least one radial port when the diameter of the sliding seal does not equal the predominant diameter of the pipe string.

Preferably the assembly includes a hydraulic jack, the hydraulic jack comprising an anchor for axially fixing the assembly to a tubular in the well, and a mandrel connectable to a lower pipe string axially moveable relative to the anchor by activation of the hydraulic actuator. In this way, the downhole assembly is a downhole pulling tool.

Preferably the valve is connected below the hydraulic jack. In this way closure of the valve can be used to commence operation of the hydraulic jack. More preferably, the valve is closed by creating tension on the pipe string. In this way, the valve can be closed prior to actuating the hydraulic jack. Preferably the valve is the ALO valve available from Ardyne AS, Norway, which operates by opening and closing the pipe string by the application of tension on the pipe string as described in EP3063364 and incorporated herein by reference. Alternatively, the valve may be a ball seat sub which operates by dropping a ball down the throughbore of the pipe string to seat in a ball seat.

Preferably, the assembly includes a casing spear connected to the lower pipe string below the valve. In this way, the downhole assembly can be used to recover casing in a well bore.

The downhole assembly may include a casing cutter connected to the lower pipe string below the casing spear. In this way, casing may be cut and pulled on the same trip into the well bore.

Preferably, the hydraulic jack includes a housing supported in the well by the string and enclosing the hydraulic actuator, the hydraulic actuator comprising a plurality of axially stacked said pistons generating a cumulative axial force, each of the plurality of pistons axially movable in response to the fluid entering a plurality of the access ports; and wherein movement of the pistons also moves the mandrel, with the mandrel being an inner mandrel extending from the housing. In this way, a great pulling force can be created downhole at the jack. Preferably the hydraulic jack is the DHPT supplied by Ardyne AS.

Alternatively, the hydraulic jack includes an outer housing arranged around an upper mandrel connected to the pipe string and enclosing the hydraulic actuator, the hydraulic actuator comprising a plurality of axially stacked pistons generating a cumulative axial force, each of the plurality of pistons axially movable in response to the fluid entering a plurality of the ports; and wherein movement of the pistons also moves a mandrel, with the mandrel being a lower mandrel extending from a lower end of the outer housing. In this way, an alternative arrangement of a hydraulic jack is provided. The hydraulic jack may be as described in GB2533022, the contents of which are incorporated herein by reference.

Preferably, in the hydraulic jack the plurality of axially stacked pistons include a plurality of inner pistons each secured to the inner mandrel and a plurality of outer pistons each secured to a tool housing supported by the string. Preferably, the axial force generated by the plurality of pistons acts simultaneously on the anchor and on the tool mandrel, such that the tool anchoring force increases when the axial force on the tool mandrel increases. Preferably, the anchor includes a plurality of slips circumferentially spaced about the mandrel for secured engagement with an interior wall in the well. Preferably, an axial force applied to the plurality of slips is reactive to the force exerted on the casing spear by the plurality of pistons.

Preferably the casing spear comprises: a sliding assembly mounted on the inner mandrel; at least one gripper for gripping onto an inner wall of the length of casing, the gripper being coupled to the sliding assembly; the sliding assembly being operable for moving the gripper between a first position in which the gripper is arranged to grip onto the inner wall of the length of casing in at least one gripping region of the length of casing and a second position in which the gripper is held away from the inner wall; and a switcher which, when advanced into the length of casing, locks the sliding assembly to the inner mandrel with the gripper in the second position; and, when the casing spear is pulled upward out of the length of casing and the switcher exits the end of the length of casing, automatically allows engagement of the length of casing by the gripper in the first position. In this way, the length of casing is automatically gripped into engagement with the casing spear when the casing spear is at the top of the length of casing. Preferably the casing spear is the Typhoon® Spear supplied by Ardyne AS.

According to a second aspect of the present invention there is provided a method of operating an actuator on a pipe string in a low level well, comprising the steps:

(a) locating a downhole assembly according to the first aspect on the pipe string with the hydrostatic equalisation device in the first configuration;
(b) running the pipe string into the well bore to a position at which the downhole assembly is to perform a task on operation of the hydraulic actuator;
(c) closing the valve;
(d) increasing fluid pressure in the throughbore at the access port to cause fluid to enter the chamber and act on a first side of the piston, thereby moving the piston to operate the hydraulic actuator and perform the task with the downhole assembly;
(e) switching the hydrostatic equalisation device to the second configuration by moving the first tubular member relative to the second tubular member and opening the at least one radial port;
(f) allowing fluid flow from the throughbore of the pipe string to the annulus outside the downhole assembly via the at least one radial port until equilibrium is reached between the throughbore and the annulus; and
(g) flowing fluid from the annulus to the chamber on the second side of the piston via the exhaust port and moving the piston relative to the chamber to re-set the hydraulic actuator.

In this way, the hydraulic actuator can be re-set in a low level well as the imbalance of hydrostatic pressures between the column of fluid in the pipe string and the low level fluid in the annulus would ordinarily prevent the piston from moving back to re-set the hydraulic actuator.

Preferably, the method comprises the additional step:

(h) switching the hydrostatic equalisation device to the first configuration by moving the first tubular member relative to the second tubular member and closing the at least one radial port.

This re-cocks the downhole assembly ready to operate again.

The method may include repeating steps (d) to (h). In this way, the hydraulic actuator can be used again while the downhole assembly is in the well.

The method may include carrying out step (e) before the piston has fully stroked across the chamber. In this way, the hydraulic actuator can be re-set at any time and is not dependent on the piston travelling entirely through the chamber.

The method may include the step of pulling the pipe string and the downhole assembly from the low level well.

Preferably the hydraulic actuator operates a hydraulic jack. In this way the task is to provide a downhole pulling tool.

Preferably the method includes attaching a casing spear to a cut section of casing and pulling the cut section of casing as the task.

Preferably the method includes attaching a casing cutter to the downhole assembly and cutting casing in the well bore to provide the cut section of casing.

Preferably, the valve is closed by pulling the pipe string. Alternatively, the valve is closed by dropping a ball into the throughbore of the pipe string and seating the ball in a ball seat.

Preferably, the method includes the step of anchoring the downhole assembly to a wall of the well. The wall may be outer casing in the well.

Preferably, step (e) occurs by setting down weight on the pipe string. More preferably, the hydraulic actuator is fixed in relation to the wall of the well when step (e) occurs. The hydraulic actuator will be fixed if the downhole assembly is anchored to a wall of the well.

Preferably, the downhole assembly is selected to have sliding seal diameter less than or equal to a prominent diameter of the pipe string.

More preferably, a second spring on the hydrostatic equalisation device between the first and second tubular members is adjusted in length to vary the force holding the at least one radial port closed in the first configuration.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Additionally, while relative terms such as 'above' and 'below' are used, this does not limit the invention to being used in a vertical well bore. The invention has equal application in inclined or deviated well bores.

Embodiments of the present invention will now be described, by way of example only, with reference to the accompanying drawings of which:

Figure 3A:
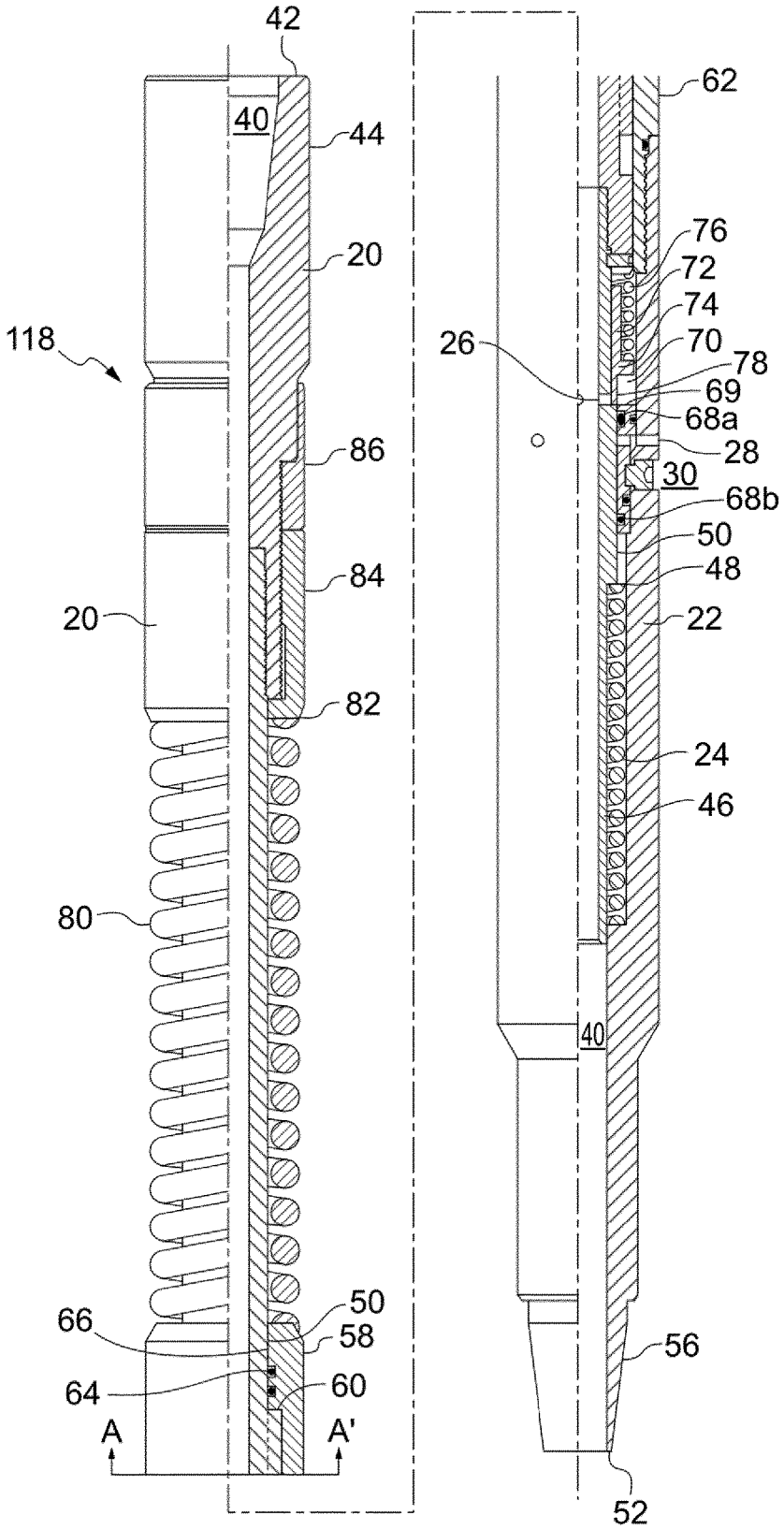
Figure 3B:
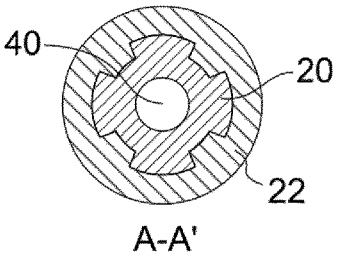
Figure 4A:
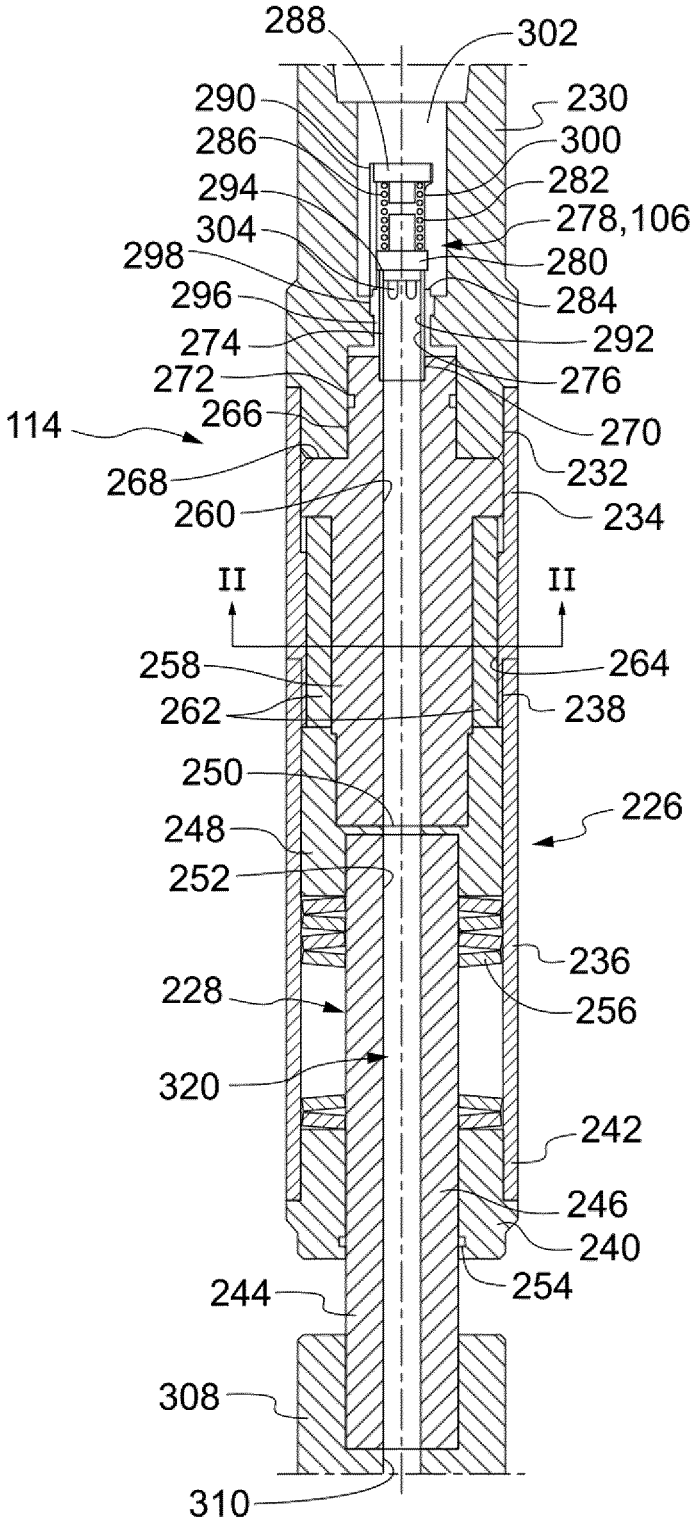
Figure 4B:
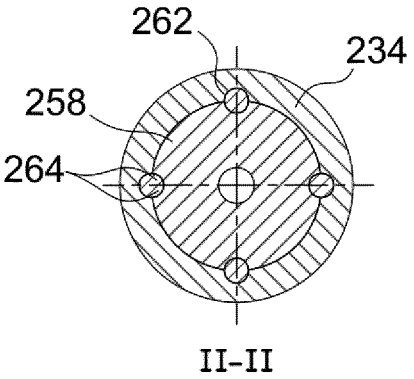
Figures 5A, 5B, 5C, 5D:
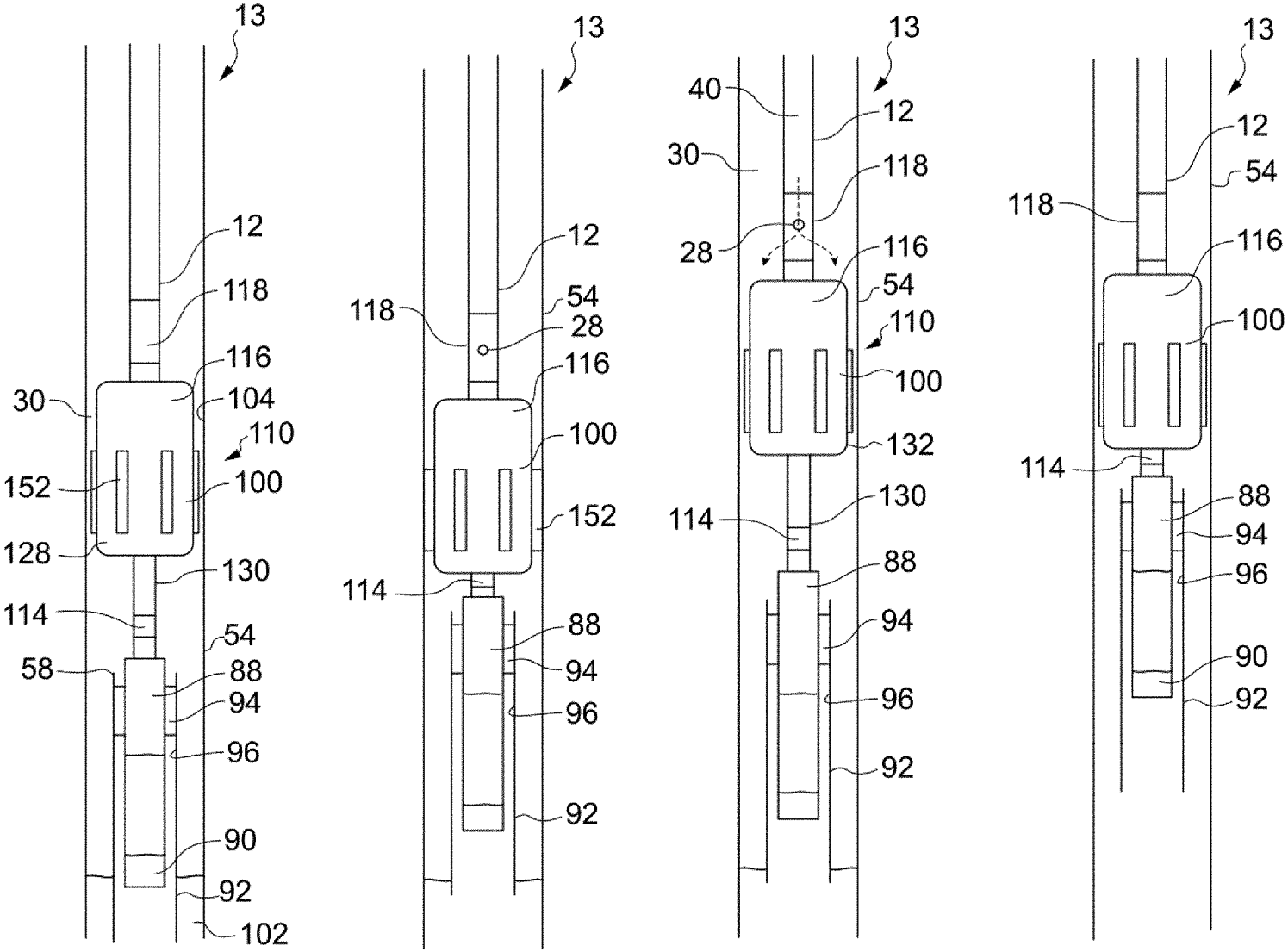

FIGS. 3(*a*) and 3(*b*) are sectional views through a hydrostatic equalisation device, according to an embodiment of the present invention;

FIGS. 4(*a*) and 4(*b*) are sectional views through a valve, according to an embodiment of the present invention; and FIGS. 5(*a*)-(*d*) illustrate apparatus and method for casing recovery in a wellbore, using a downhole assembly, according to an embodiment of the present invention.

Figure 1:
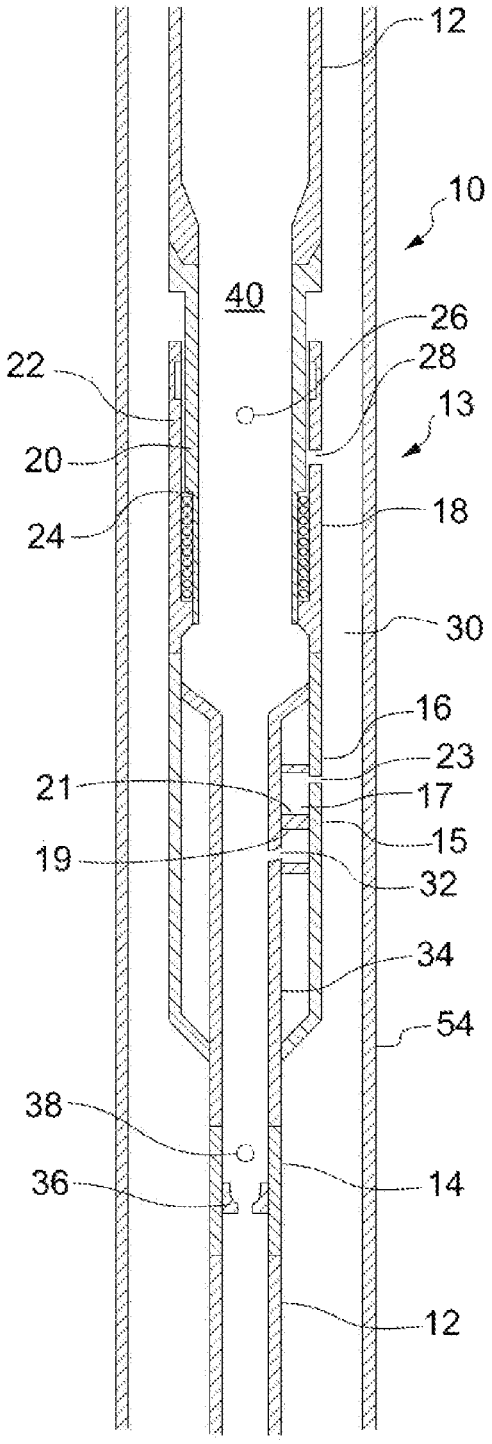
FIG. 1 is a schematic illustration of a downhole assembly according to an embodiment of the present invention.

Reference is initially made to FIG. 1 of the drawings which illustrates a downhole assembly, generally indicated by reference numeral 10, located on a pipe string 12 in a well bore 13. The assembly 10 includes a valve 14, a hydraulic actuator 16 and a hydrostatic equalisation device 18, in order according to an embodiment of the present invention.

The well bore 13 is a low level well, by which we mean the level of fluids in the annulus 30 between the assembly 10 and outer casing 54 is lower than the position of the downhole assembly 10 in the well bore 13. More particularly the fluid level in the annulus 30 will be lower than the column of fluid found in the pipe string 12. Such a well may be referred to as underbalanced.

From an upper end, being closer to the surface of the well bore, the pipe string 12 has the hydrostatic equalisation device 18 mounted therein. The hydrostatic equalisation device 18 has an inner tubular member 20 with an outer tubular member, sleeve 22 located around and supported thereon as is known in the art. The sleeve 22 is biased against the inner tubular member via spring 24. The sleeve 22 includes a radial port 28 therethrough which when aligned with a radial port 26 on the inner tubular member 20 gives access for fluid flow between a throughbore 40 of the pipe string 12 and an annulus 30 around the assembly 10. Alignment of the radial ports 26,28 can be achieved by compression of the sleeve 22 and tubular member 20 to move them towards each other and/or by rotation of the tubular member 20 within the sleeve 22. Those skilled in the art will recognise that indexing and j-slot arrangements can be located between the member 20 and the sleeve 22 to control the movement and allow repeated opening and closing of the radial port 28 to give fluid communication between the throughbore 40 of the pipe string 12 and the annulus 30 in the well 13.

The hydraulic actuator 16 may be any arrangement driven by an increase in fluid pressure against a piston 15. In the illustration of FIG. 1, fluid flows through an access port 32 to move an inner mandrel 34 which forms a lower portion of the pipe string 12. The piston 15 is contained within a chamber 17 and the access port 32 is arranged on a first side 19 of the piston 15. On the second side 21 of the piston 15, there is an exhaust port 23 which gives a fluid passageway between the inside of the chamber 17 and the annulus 30. The inner mandrel 34 provides a central bore to the hydraulic actuator 16 which is a continuation of the throughbore 40.

Below the hydraulic actuator 16, the assembly 10 has a valve 14 which is shown as a ball seat sub mounted in the pipe string 12. The ball seat sub 14 provides a ball valve seat 36 which is affixed to the inner wall of the pipe string 12. The valve 14 operates by pumping a ball 38 down the throughbore 40 which will seat in the ball valve seat 36 and create a seal across the throughbore 40, blocking fluid flow at this point. This is used to divert fluid flow from surface through the access port 32 to operate the hydraulic actuator 16. In this embodiment, once the valve 14 is closed, the hydraulic actuator can only be reset by use of the hydrostatic equalisation device 18.

The valve 14, hydraulic actuator 16 and hydrostatic equalisation device 18 may be formed integrally on a single tool body or may be constructed separately and joined together by box and pin sections as is known in the art. Two parts may also be integrally formed and joined to the third part.

In use, the assembly 10 is mounted on a pipe string 12 with the sleeve 22 covering the radial port 28. The pipe string 12 is run in the well and fluid can fill the throughbore 40. With the assembly 10 at the desired position fluid is pumped down the throughbore 40. The drop ball 38 is released into the pipe string 12 and is sized to pass through the hydrostatic equalisation device 18 and hydraulic actuator 16. The ball 38 passes through the actuator 16 and is stopped at the ball valve seat 36, seals the throughbore 40 and blocks the passage of fluid through the pipe string 12 at the valve 14. By continuing to pump fluid from surface, the fluid pressure will increase above the ball 38 and consequently fluid entering the access port 32 on the hydraulic actuator 16 will have an increased pressure. The fluid will fill the chamber 17 on the first side 19 of the piston 15 and the fluid pressure will move the piston through the chamber 17 by acting on the first side 19 and operate the actuator 16. In this embodiment the inner mandrel 34 will move relative to the upper pipe string 12. As the ball valve seat 36 is fixed, the ball 38 will remain in the seat 36 and a maximum pressure can be applied to operate the actuator 16. As we are in a low level well 13, fluid pressure on the second side 21 of the piston 15 is much lower than the pumped fluid pressure and the piston 15 will move easily.

When we wish to reset the actuator 16, in this case to move the pipe string 12 upwards relative to the inner mandrel 34, we stop pumping fluid down the throughbore 40. However, as we are in a low level well 13, pulling on the pipe string 12 from surface will have no effect. This is because the weight of the column of fluid in the pipe string 12 supported on the ball 38, provides a greater force on the first side 19 of the piston 15 than the pressure of fluid on the second side 21 of the piston 15 which will be the fluid pressure in the annulus 30. This hydrostatic imbalance prevents the hydraulic actuator 16 being released. In the present invention, the hydrostatic equalisation device 18 is used to achieve this.

On run-in and activation of the actuator the hydrostatic equalisation device 18 can be considered to have been in a first configuration wherein the bias in spring 24, held the sleeve 22 in a position in which the radial ports 26, 28 are misaligned. The radial port 28 is closed and fluid flow is entirely in the throughbore 40 past the device 18. When required, the hydrostatic equalisation device 18 is switched to a second configuration by creating relative movement between the sleeve 22 and inner tubular member 20. Dependent on the design of the device 18, this can be done by setting down weight on the pipe string 12 i.e. slacking it off, pulling on the pipe string 12 i.e. applying tension and/or by rotation of the pipe string 12, which will rotate the inner tubular member 20. Such movement aligns the radial ports 26,28 and opens the fluid passageway between the pipe string 12 and the annulus 30. It is noted that longitudinal movement is preferred over rotational as it can be more reliably performed in a well.

With the radial port 28 now open, the column of fluid which is present in the throughbore 40 will drain out of the pipe string 12. This will continue until equilibrium is reached between the fluid pressure in the pipe string 12 and the fluid pressure in the annulus 30. At this point, pressure on each side 19,21 of the piston 15 is balanced and if the pipe string 12 is pulled, the piston 15 can travel in the chamber 17 and be returned to its initial position. This will effectively reset the hydraulic actuator 16. It's also noted that the action will also move the hydrostatic equalisation device 18 back to its first configuration and the assembly is re-cocked for use again. The hydraulic actuator 16 can thus be repeatedly activated without the requirement of removing the pipe string 12 from the well or opening the valve 14 to drain the entire column of fluid from the pipe string 12.

Figure 2A:
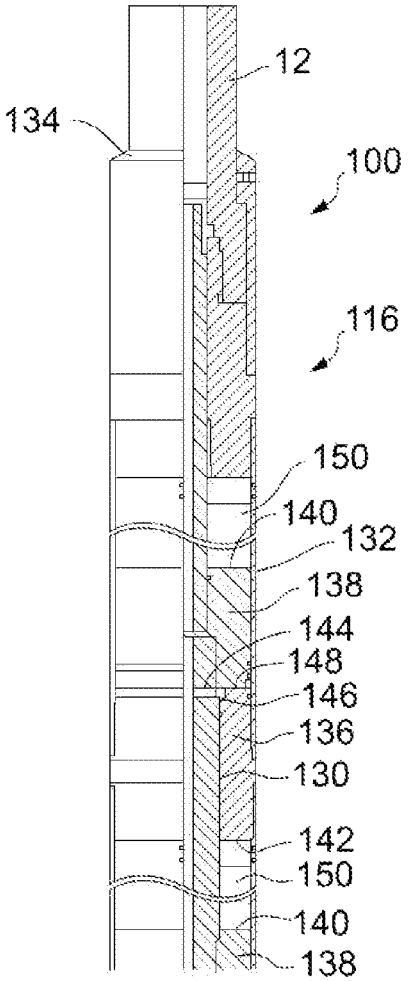
FIG. 2(*a*) is a part sectional view of an actuator section of a hydraulic jack and FIG. 2(*b*) is a part sectional view of an anchor of the hydraulic jack, according to an embodiment of the present invention.
Figure 2B:
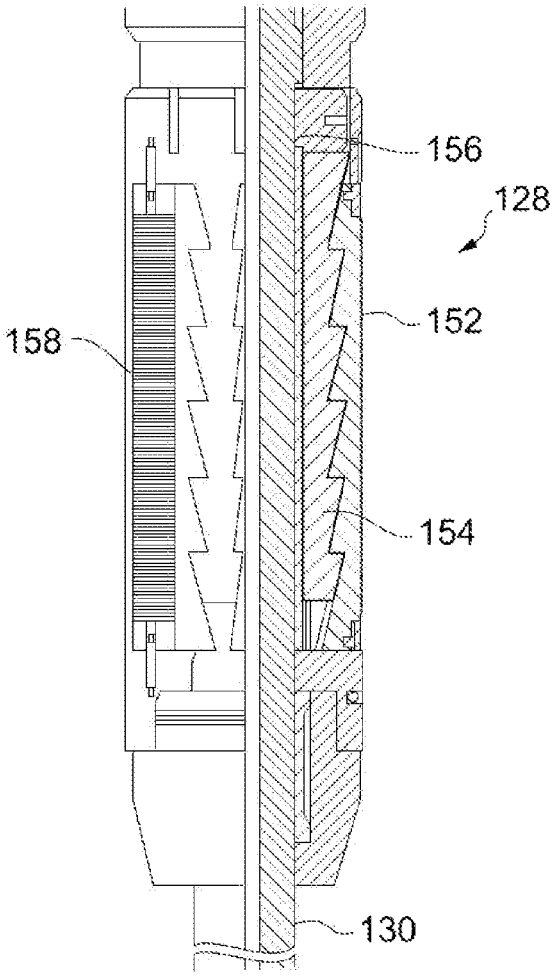

In an embodiment the hydraulic actuator 16 operates a hydraulic jack 100. A hydraulic jack 100 is illustrated in FIGS. 2(*a*) and 2(*b*). The hydraulic jack 100 has an anchor 128 and an actuator 116 system which pulls an inner mandrel 130 up into a housing 132 of the jack 100. In the preferred embodiment the hydraulic jack is the DHPT available from Ardyne AS. It is described in U.S. Pat. No. 8,365,826, the disclosure of which is incorporated herein in its entirety by reference.

Referring to FIGS. 2(*a*) and 2(*b*) there is illustrated the main features of the hydraulic jack 100. FIG. 2(*a*) shows a portion of the actuator system 116. The jack 100 has an outer housing 132 with a connection 134 to the pipe string 12. There is an inner mandrel 130 which can move axially within the housing 132. A series of spaced apart outer pistons 136 are connected into the housing 132. A series of spaced apart inner pistons 138 are connected to the inner mandrel 130. The pistons 136,138 are stacked between each other so that an upper end face 140 of an inner piston 138 will abut a lower end face 142 of an outer piston 136. Only one set of pistons 136,138 are shown but this arrangement is repeated along the mandrel 130 to provide five sets of pistons 136,138. The inner mandrel 130 includes a number of ports 144 arranged circumferentially around the mandrel 130, at the upper end of each outer piston 136, when the inner piston 138 rests on the outer piston 136. A chamber 146 is provided at this location so that fluid can enter the ports 144 to operate the actuator 116 and will act on the lower end face 148 of the inner piston 138. This will move the piston 138 upwards, crossing a vented space 150, until the upper end face 140 of the inner piston 138 abuts the lower end face 142 of the outer piston 136. This movement constitutes a stroke of the jack 100.

Movement of the inner mandrel 130 is driven by movement of the inner pistons 138. As there are multiple stacked pistons 138, the combined cross-sectional areas of the end faces 140 when fluid pressure is applied generates a considerable lifting force via the inner mandrel 130.

Hydraulic jack 100 also includes an anchor 128, shown in FIG. 2(*b*). Anchor 128 has a number of slips 152 arranged to ride up a cone 154 by the action of fluid entering a chamber 156 and moving the cone 154 under the slips 152.

The outer surface 158 of the slips 152 is toothed to grip an inner surface of the casing in which the anchor 128 is positioned. The anchor 128 is connected to the outer housing 132 so that the inner mandrel 130 can move axially relative to the anchor 128 when the anchor is set to grip the casing.

There is an alternative jack which may be used. This jack has the anchor located at the upper end and the hydraulic jack includes an outer housing arranged around an upper mandrel connected to the pipe string and enclosing the hydraulic actuator, the hydraulic actuator comprises a plurality of axially stacked pistons generating a cumulative axial force, each of the plurality of pistons axially movable in response to the fluid entering a plurality of the ports; and wherein movement of the pistons also moves the mandrel, with the mandrel being a lower mandrel extending from a lower end of the outer housing. This hydraulic jack is as described in GB2533022, the contents of which are incorporated herein by reference.

While FIG. 1 shows a simplified hydrostatic equalisation device 18, a difficulty with such pressure relief valves, circulation valves or unloader valves as they also may be referred to is in preventing relative movement between the inner tubular member and sliding sleeve until such time as they require to be operated. Any pressure differential created across the valve can cause relative movement. This is particularly the case when a lower end of the valve is fixed such as would occur when the valve is located above a DHPT. An embodiment of a hydrostatic equalisation device 118 designed to overcome this is illustrated in FIGS. 3(*a*)-(*b*). Like parts to those of the earlier figures used for clarity.

Hydrostatic equalisation device 118 includes the features of a first tubular member 20 with a second tubular member or sleeve 22 located around it, a spring 24 between the tubular member 20 and sleeve 22, and a radial port 28, which can connect the throughbore 40 to an annulus 30 outside the device 118. The first tubular member 20 has at a first end 42 a box section 44 for connecting the device 118 to a pipe string. At a lower end 46 there is a shoulder 48 on the outer surface 50 for the spring 24 to act against. Radial ports 26, of which there are four in this embodiment, are arranged through the tubular member 20. The sleeve 22 includes the radial port 28, of which there are four in this embodiment, sized to match the radial ports 26 of the tubular member 20. The sleeve 22 has at a lower end 52, a pin section 56 to connect the device into a lower pipe string or to another tool such as the hydraulic actuator 16. At an upper end 58 the sleeve 22 is supported on the tubular member 20 by a shoulder 60. The shoulder 60 is at an end of a splined arrangement 62, as is known in the art, which allows the sleeve 22 and tubular member 20 to move longitudinally with respect to each other without rotation. This telescopic movement without rotation is required to ensure that the radial ports 26,28 align and is shown in cross-section in FIG. 3(*b*). At the upper end 58 is also arranged a sliding seal 64 between the outer surface 50 of the tubular member and the inner surface 66 of the sleeve 22 which prevents fluid passing through the device 118 when the radial port 28 is closed. Additional seals 68*a,b* are arranged at opposite sides of the radial port 28 also.

Hydrostatic equalisation device 118 includes two additional features: the first to prevent exposure and possible loss of a seal 68*a*, when the tubular member 20 and sleeve 22 are moved relative to each other; and the second to assist in opening the radial port 28 when this is required.

A shoulder 69 on one side of the radial port 28 is initially aligned against a lower side of the radial port 26, which together form an end of an annular chamber 70 between the tubular member 20 and the sleeve 22, with the opposing end being a portion of the tubular member 20. Within the chamber 70 is a piston sleeve 72 including an annular piston face 74 extending therefrom. A spring 76, of lower strength than spring 24, is located between the face 74 and the tubular member end of the chamber 70. A lower end 78 of the piston sleeve 72 abuts the lower side of the radial port 26 and thereby covers the port 26. The shoulder 69 includes the seal 68*a* held against the outer surface 50 of tubular member 20 when the hydrostatic equalisation device 118 is in the first configuration as described above. When the hydrostatic equalisation device 118 is switched to the second configuration, the tubular member 20 moves downwards relative to the sleeve 22 against the bias of spring 24. The piston sleeve 72 will move down with the member 20 as it abuts it and is biased by the spring 76. The piston sleeve 72 will then be stopped by the piston face 74 meeting the shoulder 69 with the tubular member continuing to move downwards. When the piston sleeve 72 is stopped, its lower end 78 will have travelled under the shoulder 69 and be covering the seal 68*a*, so the seal has never been exposed. The lower end 78 is sized to the length of the shoulder 69 so that continued movement of the tubular member 20 aligns the radial ports 26,28 with each other and creates the fluid path from the throughbore 40 to the annulus 30. Radial port 26 is prevented from passing radial port 28 by virtue of an upper end of the piston sleeve 72 reaching the end wall of the chamber 70 by virtue of compression of the spring 76. Thus the radial ports 26,28 stay aligned as long as weight is set down on the device 118 and the seals 68*a,b* are never exposed in use.

The second feature is required as the device 118 is designed to be pressure balanced, which is the requirement that until a mechanical action is taken i.e. setting down weight, the device 118 will not activate so that the application of fluid pressure neither opens nor closes the device. This is particularly relevant were, as in a preferred embodiment, the sleeve 22 is axially fixed in the well.

If the sliding seal 64 diameter on the device 118 is the same as the 'predominant running string diameter' then pressure during run-in or when pumping fluid down the pipe string 12 will have no effect. Predominant running string diameter (PRSD) is the weighted average diameter of the pipe from surface down to the device 118. Weighted average allows for restrictions at tool joints and variations in actual pipe inner diameter. It is not possible in practice to perfectly balance any tool. If the sliding seal 64 diameter is larger than the PRSD then the device 118 will want to stroke to open the radial port 28 when pressure is applied down the throughbore 40, referred to as Design A in this analogy. Conversely if the sliding seal 64 diameter is smaller than the PRSD then no amount of pressure will open the valve, Design B. It is Design B that the device 118 must operate with because: when the assembly 10 is axially fixed in the well, pulling and applying tension strokes the device 118 out and closes the radial port 28; in the underbalanced well, the pipe string 12 must be filled in order to pressure up to activate the hydraulic actuator 16; and as the pipe string 12 is filled a pressure differential is created between the pipe string 12 and annulus 30 due to the hydrostatic head. If Design A is used, an ever larger pull on the pipe string 12 would be needed to keep the radial port 28 closed. However, with Design B the radial port 28 will not open. Design B is therefore required and the device 118 will only open the radial port 28 when the overpull is released and weight is set down. However, if the imbalance is too large then there may not be enough weight to overcome the force holding the device 118 closed. This force is:

Hydrostatic pressure×(PRSD Area−sliding seal diameter area)

Thus the device 118 can only be opened if there is sufficient weight to overcome the imbalance force. In practice, different tool sizes are produced for each of the possible running string diameters. However, this is expensive. The present invention overcomes this by incorporating the second feature which reduces the number of different devices 118 for reasons of inventory and cost.

The second feature is based on the device 118 being connected to pipe string 12 where the PRSD is sized close to but larger than the sliding seal 64 diameter. An adjustable spring 80 is located between the upper end 58 of the sleeve 22 and an opposing shoulder 82 towards the first end 42 of the tubular member 20. The force of this spring 80 is significantly greater than that of the other springs 24, 76 and will therefore increase the force supplied when weight is set down. The adjustable spring 80 is adjusted to meet the requirements of the mismatch in the PRSD area and the sliding seal diameter area. Adjustment is by varying the distance between the end 58 and shoulder 82, which is achieved by having shoulder 82 on an adjustment sleeve 84 which is screw threaded to the outer surface 50 of the tubular member 20. A lock sleeve 86, as is known in the art, is also used.

In use, the device 118 is run in on the pipe string 12 in the first configuration with the radial port 28 closed by virtue of the misalignment of the radial ports 26,28. The sleeve 22 is fixed and tension applied to the device 118 by pulling of the pipe string 12 will keep the radial port 28 closed. When the device 118 requires to be switched to the second configuration to open the radial port 28, fluid pumping is stopped, tension is slackened off and the weight of the pipe string 12 allowed to act on the device 118. This will cause the tubular member 20 to move longitudinally downwards telescoping into the sleeve 22. The bias of the adjustable spring 80 is first taken up and then the bias of the spring 76 follows. This provides the final movement which will move the piston sleeve 72 over the shoulder 69 and expose the radial port 26 in the tubular member to the radial port 28 in the sleeve 22. The column of fluid in the pipe string 12 will pass to the annulus 30 through the now aligned radial ports 26,28. The application of tension by pulling on the string 12 can be used to switch the device 118 back to the first configuration as it repositions all the components and closes the radial port 28 again.

The valve 14, is shown as a ball seat sub in FIG. 1. In a preferred embodiment the valve 14 is resettable so that fluid can be drained through the pipe string 12 and downhole assembly 10 when the downhole assembly 10 is to be pulled from the well 13. A suitable valve 114 is illustrated in FIGS. 4(*a*) and 4(*b*). This is an ALO valve which is available from Ardyne AS, Norway, and operates by opening and closing the pipe string by the application of tension on the pipe string as described in EP3063364 and incorporated herein by reference.

The valve 114 operates in two positions. In the initial position, as shown in FIG. 4(*a*), the pre-tensioned main spring 256 pushes the slider 248 and thereby the grooved shaft 258 with the actuating sleeve 274 in the direction of the opening and closing mechanism 278. The telescope pipe 244 is pulled into the spring housing 236, and the end face 294 of the actuating sleeve 274 pushes the valve body 280 towards the valve spring 286 and away from the valve seat 284. The shoulder 268 of the grooved shaft 258 comes into abutment against the end piece 230 as an end stop. In this initial position there is a through-going fluid channel from the end piece 230 via the chamber 302, the opening 300 in the valve sleeve 282, the openings 304 in the actuating sleeve 274, the bore 260 of the grooved shaft 258, the bore 250 of the slider 248, the passage 252 of the telescope pipe 244 and a bore 310 in the coupling piece 308.

In the activated state, sufficient tensile force has been applied between the end piece 230 and the coupling piece 308 to overcome the force of the pre-tensioned main spring 256 and thereby pull the telescope pipe 2244 and the slider 48 in the direction against the spring 256. The grooved shaft 258 and the actuating sleeve 274 follows the movement of the slider 248 and the valve spring 286 moves the valve body 280 towards the valve seat 284. The opening and closing mechanism 278 closes as the valve body 280 lands on the valve seat 284, and fluid cannot flow in at the end piece 230 and out at the coupling piece 308.

Reference is now made to FIGS. 5(*a*)-(*d*) which illustrate a method of casing recovery using a downhole assembly 110. Those parts referred to in FIGS. 1 to 4 have been given the same reference numeral. The assembly 110 now includes a casing spear 88 and a casing cutter 90. The assembly 110 is mounted on the pipe string 12 and the pipe string 12 is a drill string typically run from a rig (not shown) via a top drive/elevator system which can raise and lower the string 12 in the well 13. The casing cutter 90 and casing spear 88 are run into a first casing 92 in the well 13. The well 13 has a second casing 54 in which the first casing 92 is located. In an embodiment, casing 92 is 9⅝" (244 mm) in diameter while the outer casing 54 is 13⅜" (340 mm) diameter.

In a preferred embodiment the casing spear 88 comprises: a sliding assembly mounted on an inner mandrel; grippers 94 for gripping onto an inner wall 96 of the length of casing 92, the grippers 94 being coupled to the sliding assembly; the sliding assembly is operable for moving the grippers 94 between a first position in which the grippers 94 are arranged to grip onto the inner wall 96 of a length of casing 92 in at least one gripping region of the length of casing 92 and a second position in which the grippers 94 is held away from the inner wall 96; and a switcher which, when advanced into the length of casing 92, locks the sliding assembly to the inner mandrel with the grippers 94 in the second position; and, when the casing spear 88 is pulled upward out of the length of casing 92 and the switcher exits the end of the length of casing 92, automatically allows engagement of the length of casing 92 by the grippers 94 in the first position. In this way, the length of casing 92 is automatically gripped into engagement with the casing spear 88 when the casing spear 88 is at the top 98 of the length of casing 92. In a preferred embodiment the casing spear 88 is the Typhoon® Spear supplied by Ardyne AS.

Casing cutter 90 may be any tool which is capable of cutting casing downhole in a well bore. A pipe cutter, section mill, jet cutter, laser cutter and chemical cutter are a non-exhaustive list of possible casing cutters.

As shown in FIG. 5(*a*) the downhole assembly 110 is run in the well and the casing cutter 90 has been used to cut the casing 92 to separate it from the remaining casing string. The cut casing may be over 100 m in length. It may also be over 200 m or up to 300 m. Behind the casing 92 there may be drilling fluid sediments, partial cement, sand or other settled solids in the annulus between the outside of the casing 92 and the casing 54. This material 102 can prevent the casing 92 from being free to be pulled from the well 13. On run-in the downhole assembly 110 is in the first configuration with the radial port 28 closed on the hydrostatic equalisation device 118 and the valve 114 is open so that all flow is along the throughbore 40. With the casing 92 cut, the pipe string 12 is raised so that the casing spear 88 grips the upper end 98 of the casing 92.

To operate the hydraulic jack 100, the string 12 is pulled and tension applied to the valve 114. As the valve 114 is axially fixed by attachment to the casing 92 via the casing spear 88, the valve 114 closes, sealing the throughbore 40 and blocking the passage of fluid through the pipe string 12 at the valve 114. By continuing to pump fluid from surface, the fluid pressure will increase above the valve 114 and consequently fluid entering the ports 144 on the hydraulic actuator 16 will have an increased pressure. Initially fluid will enter the chamber 156 of the anchor 128 and set the slips 152 against the inner wall 104 of the outer casing 54. With the hydraulic jack 100 held in place, fluid at the increased pressure will enter the actuator 116, through ports 144 and move the pistons 138 thereby raising the inner mandrel 130 relative to the upper pipe string 12. As the inner mandrel 130 forms a lower pipe string 12 and is connected to the casing spear 88, the cut section of casing 92 is raised. As tension is maintained on the valve 114 it remains closed. Tension has also been maintained on the hydrostatic equalisation device 118 and the radial ports 28 remain closed so that a maximum pressure can be applied to operate the actuator 116. This is as illustrated in FIG. 5(*b*).

It is hoped that the jack 100 can make a full stroke to give maximum lift to the casing 92. This is illustrated in FIG. 5(*b*). If the casing 92 is still stuck only a partial stroke will be achieved. In either case, the anchor 128 now needs to be unset. Fluid pumping is stopped and the pipe string 12 is slackened off so that weight is set down on the tubular member 20. The radial ports 26,28 align and the column of fluid in the throughbore 40 at the device 118 drains from the pipe string 12 until equilibrium is reached with the annular volume 30. The anchor 128 is unset by the setting down of weight and the hydraulic jack 100 can be repositioned by pulling on the pipe string 12 to extend the mandrel 130 from the outer housing 132 of the jack 100. This occurs as fluid can enter the second side 21 of the piston 15 in the actuator 116 as the pressure across the pistons is balanced. FIG. 5(*c*) shows the hydraulic jack 100 in a raised position with the mandrel 130 extended.

If the section of casing 92 is free, the pipe string 12, downhole assembly 110 and recovered casing 92 can be raised out of the well 13 as illustrated in FIG. 5(*d*). On raising the string 12, if a drop ball seat is used as the valve 14, then the throughbore 40 has remained blocked and a column of fluid in the pipe string 12 remains. This results in a need for handling a wet string at surface. If the ALO valve 114 is used, when pulling the string 12, the valve 114 will open and the remaining column of fluid can drain down the throughbore 40 and out of the end of the pipe string 12. This advantageously removes the requirement to handle a wet string at surface.

If the section of casing 92 is not free, the pipe string 12 will stop when the inner mandrel 130 is fully extended, at FIG. 5(*c*). To use the hydraulic jack 100 again, the procedure is repeated to set down weight, close valve 114, set anchor 128, operate actuator 116 to activate jack 100 and pull on casing 92, open port 28 on hydrostatic equalisation device 118, drain string 12 to reach pressure equilibrium and release and re-cock the hydraulic jack 100. The steps can be repeated until the cut section of casing 92 is free and the downhole assembly 110 and casing 92 can be pulled from the well 13.

The downhole assembly 110 may further include a hydraulic disconnect, which releases under load, between the jack 100 and valve 114. This allows for a contingency release of the string 12 from the casing 92 due to well constraints on torque.

The principle advantage of the present invention is that it provides a downhole assembly and method of operating a hydraulic actuator on a pipe string which allows repeated operation of the hydraulic actuator in a low level well.

A still further advantage of the present invention is that it provides a downhole assembly and method for casing recovery in a low level well which allows repeated operation of a hydraulic jack in the well.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended with the invention being defined within the scope of the claims.

The invention claimed is:

1. A downhole assembly for use in a low level well, comprising:

a hydrostatic equalisation device, the hydrostatic equalisation device comprising:

a first tubular member with a first end configured to connect to a pipe string, and a second tubular member configured to move relative to the first tubular member, the second tubular member comprising at least one selectively openable and closeable radial port wherein the at least one radial port is configured to give fluid access between a throughbore of the pipe string and an annulus around the downhole assembly in the open configuration, and the radial port is configured to prevent fluid access between a throughbore of the pipe string and an annulus around the downhole assembly in the closed configuration;

a hydraulic actuator comprising:

a tool body including a central bore and a first end configured to connect to the hydrostatic equalisation device, and a piston configured to move in a chamber, the chamber comprising an access port from the central bore on a first side of the piston and an exhaust port to the annulus on a second side of the piston; and a valve, the valve comprising:

an obturating member configured to block fluid flow through the central bore to divert fluid flow from the throughbore into the chamber via the access port;

the downhole assembly comprising a first configuration and a second configuration, wherein:

in the first configuration, the at least one radial port is in the closed configuration and the downhole assembly is configured to allow fluid flow from the throughbore into the chamber via the access port to act on the first side of the piston thereby allowing movement of the piston, relative to the chamber, from a first position to actuate the hydraulic actuator; and in the second configuration, the at least one radial port is in the open configuration and the downhole assembly is configured to allow fluid flows from the throughbore to the annulus to equalise pressure between the throughbore and the annulus, and on equalisation to allow fluid flows into the chamber via the exhaust port thereby allowing movement of the piston, relative to the chamber, back to the first position to re-set the hydraulic actuator in preparation to repeat actuation of the hydraulic actuator.

2. A downhole assembly according to claim 1 wherein the first tubular member and the second tubular member are biased to move telescopically relative to each other between the open configuration and the closed configuration, and there is a sliding seal located between the first tubular member and the second tubular member.

3. A downhole assembly according to claim 1 wherein the first tubular member and the second tubular member are configured to rotate relative to each other between the open configuration and the closed configuration, and there is a sliding seal located between the first tubular member and the second tubular member.

4. A downhole assembly according to claim 1 wherein the hydrostatic equalisation device includes a spring configured to bias the first tubular member and the second tubular member in the first configuration.

5. A downhole assembly according to claim 2 wherein a diameter of the sliding seal is less than a predominant diameter of the pipe string.

6. A downhole assembly according to claim 4 wherein the hydrostatic equalisation device includes a second spring configured to bias the first tubular member and the second tubular member, wherein the force of the second spring is adjustable.

7. A downhole assembly according to claim 1 wherein the downhole assembly includes a hydraulic jack, the hydraulic jack comprising an anchor configured to axially fix the downhole assembly to a tubular in the well, and a mandrel connectable to a lower pipe string axially moveable relative to the anchor by actuation of the hydraulic actuator.

8. A downhole assembly according to claim 1 wherein the downhole assembly includes a casing spear connected to the pipe string below the valve.

9. A downhole assembly according to claim 8 wherein the downhole assembly includes a casing cutter connected to the pipe string below the casing spear.

10. A method of operating a hydraulic actuator on a pipe string in a low level well, comprising the steps:

(a) attaching a downhole assembly on the pipe string, the downhole assembly comprising a hydrostatic equalisation device,
a hydraulic actuator and
a valve;

(b) opening the valve:

(c) running the pipe string and the downhole assembly into the well and flowing fluid through a central bore of the hydraulic actuator and a throughbore of the pipe string;

(d) closing the valve, blocking fluid flow through the central bore and diverting flow from the throughbore into a chamber in the hydraulic actuator via an access port;

(e) increasing fluid pressure in the throughbore at the access port to cause fluid to entering the chamber to act on a first side of a piston in the chamber, moving the piston relative to the chamber, from a first position, and thereby actuating the hydraulic actuator;

(f) releasing fluid from the chamber through an exhaust port on a second side of the piston;

(g) moving a first tubular member relative to a second tubular member of the hydrostatic equalisation device, opening a radial port on the hydrostatic equalisation device, and giving fluid access between the throughbore of the pipe string and an annulus around the downhole assembly;

(h) allowing fluid flow from the throughbore of the pipe string to the annulus outside the downhole assembly via the radial port until equilibrium is reached between the throughbore and the annulus; and (i) flowing fluid from the annulus to the chamber on the second side of the piston via the exhaust port, moving the piston relative to the chamber, back to the first position, and thereby re-setting the hydraulic actuator.

11. A method of operating a hydraulic actuator on a pipe string in a low level well according to claim 10 wherein the method comprises the additional step:

(j) moving the first tubular member relative to the second tubular member and closing radial port.

12. A method of operating a hydraulic actuator on a pipe string in a low level well according to claim 11 wherein the method includes repeating steps (e) to (j).

13. A method of operating a hydraulic actuator on a pipe string in a low level well according to claim 10 wherein the method includes carrying out step (g) before the piston has fully stroked across the chamber.

14. A method of operating a hydraulic actuator on a pipe string in a low level well according to claim 10 wherein the method includes the step of pulling the pipe string and the downhole assembly from the low level well.

15. A method of operating a hydraulic actuator on a pipe string in a low level well according to claim 10 wherein the method includes attaching a hydraulic jack to a stuck object and jacking the object free.

16. A method of operating a hydraulic actuator on a pipe string in a low level well according to claim 10 wherein the method includes attaching a casing spear to a cut section of casing and pulling the cut section of casing.

17. A method of operating a hydraulic actuator on a pipe string in a low level well according to claim 16 wherein the method includes attaching a casing cutter to the downhole assembly and cutting casing in the well bore to provide the cut section of casing.

18. A method of operating a hydraulic actuator on a pipe string in a low level well according to claim 10 wherein the valve is closed by pulling the pipe string to apply tension to the valve.

19. A method of operating a hydraulic actuator on a pipe string in a low level well according to claim 10 wherein the valve is closed by dropping a ball into the throughbore and seating the ball in a ball seat.

20. A method of operating a hydraulic actuator on a pipe string in a low level well according to claim 10 wherein the method includes the step of axially fixing the hydraulic actuator in the well and step (e) occurs by setting down weight on the pipe string when the hydraulic actuator is axially fixed in the well.

* * * * *